US010265999B2

(12) United States Patent
Depoi et al.

(10) Patent No.: US 10,265,999 B2
(45) Date of Patent: Apr. 23, 2019

(54) ENVELOPE INSERTER WITH VARIABLY ACTIVATED SUCTION CUPS

(71) Applicant: DMT Solutions Global Corporation, Danbury, CT (US)

(72) Inventors: Arthur H Depoi, Brookfield, CT (US); Anthony E. Yap, Danbury, CT (US); Xavier Padros, New Milford, CT (US)

(73) Assignee: DMT Solutions Global Corporation, Danbury, CT (US)

( * ) Notice: Subject to any disclaimer, the term of this patent is extended or adjusted under 35 U.S.C. 154(b) by 350 days.

(21) Appl. No.: 15/019,994

(22) Filed: Feb. 10, 2016

(65) Prior Publication Data

US 2016/0243885 A1 Aug. 25, 2016

Related U.S. Application Data

(60) Provisional application No. 62/118,548, filed on Feb. 20, 2015.

(51) Int. Cl.
*B43M 3/04* (2006.01)
*B43M 7/00* (2006.01)

(52) U.S. Cl.
CPC ..... *B43M 7/00* (2013.01); *B43M 3/045* (2013.01)

(58) Field of Classification Search
CPC ..... B43M 3/00; B43M 3/04; B43M 3/045; B43M 7/00
USPC ..... 53/460, 492, 569, 381.1, 381.5, 381.6; 270/58.06
See application file for complete search history.

(56) References Cited

U.S. PATENT DOCUMENTS

| | | | | |
|---|---|---|---|---|
| 4,079,576 | A * | 3/1978 | Morrison et al. | B43M 3/045 53/569 |
| 4,674,258 | A | 6/1987 | Ehlscheid | |
| 5,618,375 | A * | 4/1997 | Suzuki et al. | B43M 5/042 53/381.6 |
| 6,293,076 | B1 | 9/2001 | Miller | |
| 6,978,583 | B2 | 12/2005 | Rozenfeld | |
| 7,181,895 | B1 | 2/2007 | Rozenfeld | |
| 7,600,755 | B1 | 10/2009 | Rozenfeld | |
| 8,281,919 | B2 | 10/2012 | Rozenfeld | |
| 8,439,182 | B2 | 5/2013 | Rozenfeld | |
| 2004/0211158 | A1* | 10/2004 | Miller et al. | B43M 3/045 53/381.6 |
| 2005/0060966 | A1* | 3/2005 | Ballestrazzi et al. | B43M 3/045 53/569 |
| 2006/0254223 | A1 | 11/2006 | Passoni | |

* cited by examiner

*Primary Examiner* — Stephen F. Gerrity
(74) *Attorney, Agent, or Firm* — Brown Rudnick LLP

(57) ABSTRACT

An apparatus and method for opening an envelope for insertion of a collation. The apparatus includes a plurality of actuated suction cups that are positioned above an envelope in an insertion station. The actuated suction cups move downward to engage a top surface of the envelope and to lift the top surface away from the bottom surface in order to facilitate insertion of the collation. The suction cups include a first group that is actuated for opening all envelopes, and a second group, independently actuatable from the first group, and that is actuated only for opening envelopes having characteristics that require the additional suction cups.

13 Claims, 5 Drawing Sheets

ENVELOPE INSERTER WITH VARIABLY ACTIVATED SUCTION CUPS

FIELD OF THE INVENTION

The present invention relates generally to multi-station document inserting systems, which assemble batches of documents for insertion into envelopes. More particularly, the present invention is directed toward an envelope feeder-insert station having a plurality of suction cups for opening envelopes in preparation for insertion of documents.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the MPS and Epic™ series inserter systems available from Pitney Bowes, Inc., Stamford, Conn.

In many respects the typical inserter system resembles a manufacturing assembly line. Sheets and other raw materials (other sheets, enclosures, and envelopes) enter the inserter system as inputs. Then, a plurality of different modules or workstations in the inserter system work cooperatively to process the sheets until a finished mailpiece is produced. The exact configuration of each inserter system depends upon the needs of each particular customer or installation. For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to the burster-folder station for separating and folding. A control scanner located in the burster-folder station senses the control marks on the control documents. Thereafter, the serially arranged insert feeder stations sequentially feed the necessary documents onto a transport deck at each station as the control document arrives at the respective station to form a precisely collated stack of documents which is transported to the envelope feeder-insert station where the stack is inserted into the envelope. The transport deck preferably includes a ramp feed so that the control documents always remain on top of the stack of advancing documents. A typical modern inserter system also includes a control system to synchronize the operation of the overall inserter system to ensure that the collations are properly assembled.

With regard to the envelope feeder-insert station, they are critical to the operation of document inserting systems. Typically, such an envelope insert device inserts collated enclosures into a waiting envelope. At the insert station, one or more suction devices can be used to pull open an envelope so that it is ready to receive a collation of documents. Prior art insert stations use open loop actuators (air cylinders) that open a fixed amount. Depending on the collation thickness, the fixed opening amount may not be best suited for a particular job. Also, depending on the width of the envelope, the suction cups may have to be manually moved across the throat of the envelope for optimum opening. The same setting may not work for both a narrow envelope and a wide envelope. This adjustment is typically manual and can be difficult to adjust correctly for untrained operators.

Conventional insert stations are shown in the following U.S. patents, which are hereby incorporated by reference:

- U.S. Pat. No. 6,978,583—High Speed Vacuum System for Inserters;
- U.S. Pat. No. 7,181,895—Jam Tolerant Mail Inserter;
- U.S. Pat. No. 7,600,755—System and Method for Preventing Envelope Distortion in a Mail Piece Fabrication System;
- U.S. Pat. No. 8,281,919—System for Controlling Friction Forces Developed on an Envelope in a Mailpiece Insertion Module;
- U.S. Pat. No. 8,439,182—Mail Piece Inserter Including System for Controlling Friction Forces Developed on an Envelope.

SUMMARY OF THE INVENTION

Accordingly, the instant invention provides an apparatus for opening an envelope for insertion of a collation. The apparatus includes a plurality of actuated suction cups that are positioned above an envelope in an insertion station. The actuated suction cups move downward to engage a to surface of the envelope and to lift the top surface away from the bottom surface in order to facilitate insertion of the collation. The suction cups include a first group that is actuated for opening all envelopes, and a second group, independently actuatable from the first group, and that is actuated only for opening envelopes having characteristics that require the additional suction cups.

In the preferred embodiment, there are three suction cups arranged in a line above a width of the insertion station. In this arrangement, the middle suction cup is used for opening all envelopes, and the two outer suction cups are used selectively for larger envelopes. The suction cups are mounted on pivot arms that are engaged through linkages with a cam mechanism that causes the suction cups to be pivotably raised and lowered.

In the more generic preferred embodiment, the first group of one or more suction cups is mounted on one or more first pivot arms and the second group of one or more suction cups is mounted on one or more second pivot arms. The cam mechanism includes a first cam and first cam follower for controlling the first group and a second cam and second cam follower for controlling the second group. The first and second cams have different surface profiles that cause differing operation of the first and second groups.

In the preferred embodiment, the first and second cams are comprised from a single dual profile cam that is rotated on a single axial shaft that is turned by a motor. The dual profile cam includes a first range of angular operation where the profiles of the first and second cams are the same. There is a second range of angular operation where the profiles are different, and the two groups will behave differently during rotation through the second range. In particular, the second range of angular operation of the dual profile cam may cause just the first group to be actuated for envelope opening while the second group does not move.

BRIEF DESCRIPTION OF THE DRAWINGS

The above and other objects and advantages of the present invention will become more readily apparent upon consideration of the following detailed description, taken in conjunction with accompanying drawings, in which like reference characters refer to like parts throughout the drawings and in which.

DETAILED DESCRIPTION OF THE PREFERRED EMBODIMENT

Figure 3:
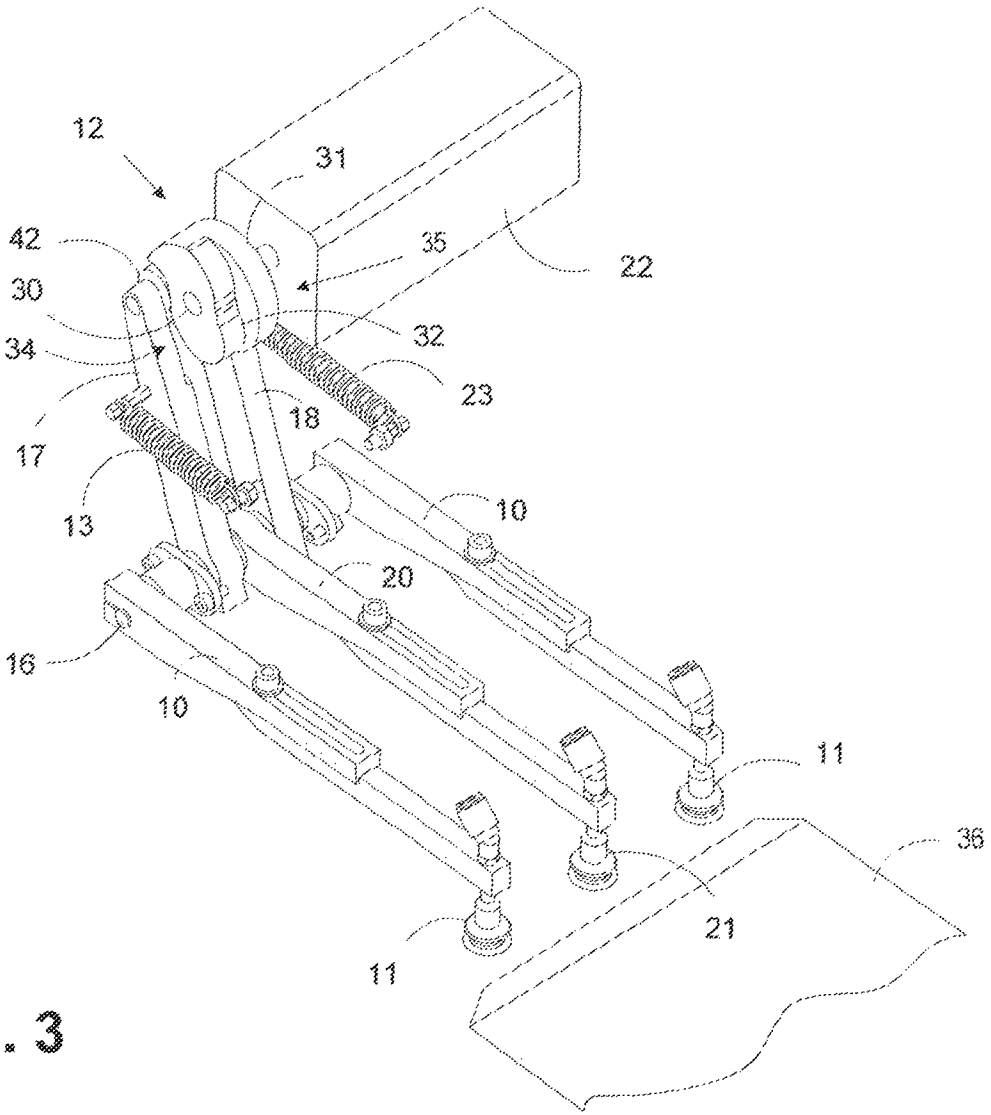
FIG. 3 is an isometric view showing suction cup apparatus being used in the manner in which all of the suction cups go up and down together.
Figure 4:
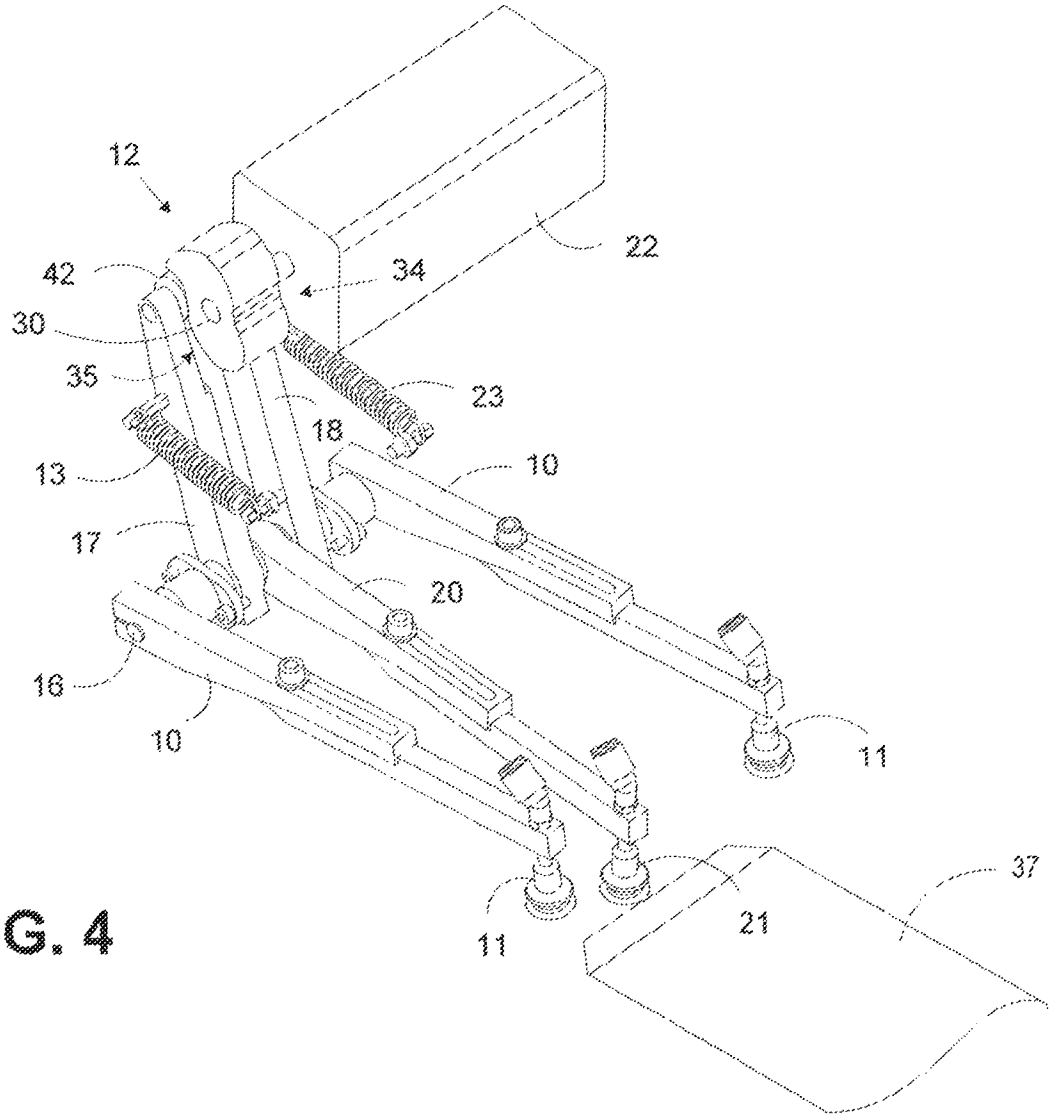
FIG. 4 is an isometric view showing suction cup apparatus being used in the manner in which just the middle arm will move, white the others remain up.

As seen in FIGS. 3 and 4, the preferred embodiment includes three suction cups 11 and 21. The two outer suction cups 11 are used in conjunction with the middle suction cup 21 for larger envelopes 36 (FIG. 3). For smaller envelopes 37, just the middle suction cup 21 is used while the outer two suction cups 11 are kept unused in a raised position. These two different modes of operation are controlled by the position of the dual cam 12, as will be discussed in more detail below.

Figure 1:
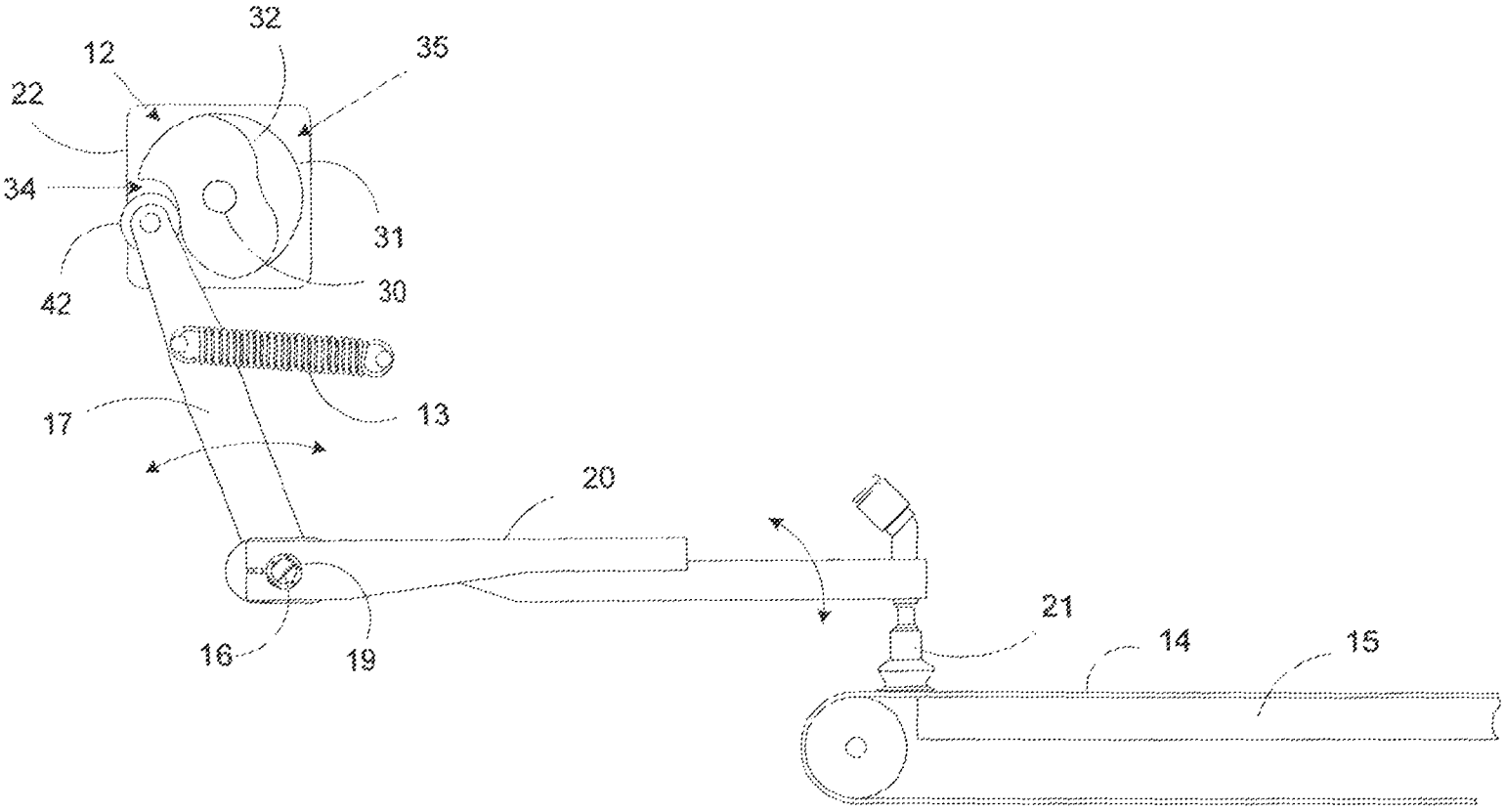
FIG. 1 is a side view showing a middle suction cup arm and movement mechanism, in the preferred embodiment having three suction.

FIG. 1 shows details of the mechanism for the middle suction cup 21. An envelope to be opened by the suction cup 21 is supported on a vacuum deck 15 and a belt transport 14. The vacuum cup 21 is mounted on a mounting arm 20 that is fixedly attached to cam follower arm 17. Together, the mounting arm 20 and the cam follower arm 17 form a pivoting arm that pivots around axial rod 16. For this embodiment arm 20 is not attached to rod 16 but pivots around it via rotating mount 19. A spring 13 biases the cam follower arm 17 and mounting arm 20 to rotate around the axial rod 16 in a clockwise direction, relative to FIG. 1, and to thereby bias the suction cup 21 in a downward direction. A cam follower 42 is mounted on the end of cam follower arm 17, and is in operative contact with dual cam 12.

Dual cam 12 is turned by a motor 22 that turns the cam axis 390. Dual cam 12 includes a first cam surface 32 and a second cam surface 31. The cam follower 42 for the middle suction cup 21 is in contact with the first cam surface 32. As the motor 22 turns the dual cam 12, surface 32 will push against cam follower 42 and correspondingly cause the pivot arm to pivot and the suction cup 21 to rise and fall depending on the depth of the cam surface 32 at a particular angular position.

Figure 2:
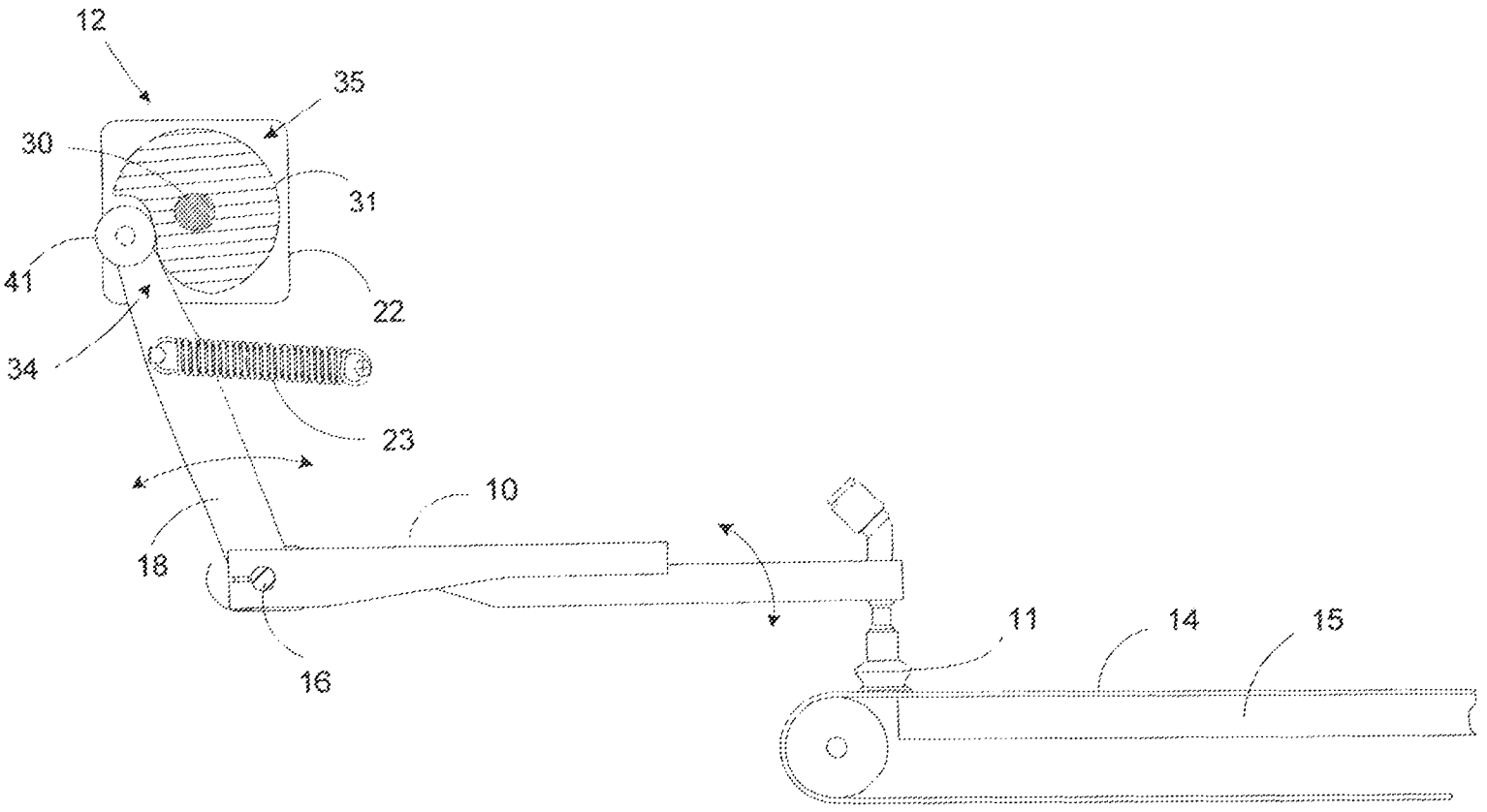
FIG. 2 is a side view depicting one of the outer two suction cup arms and movement mechanism, in the preferred embodiment having three suction cups.

Similar to FIG. 1, FIG. 2 shows details of the mechanism for the two outer suction cups 11. The vacuum cup 11 is mounted on a mounting arm 10 that is fixedly attached to cam follower arm 18. Together, the mounting arm 10 and the cam follower arm 18 form a pivoting arm that pivots with connecting axial rod 16. A spring 23 biases the cam follower arm 18 and mounting arm 10 to rotate the axial rod 16 in a clockwise direction, relative to FIG. 2, and to thereby bias the suction cup 11 in a downward direction. A cam follower 41 is mounted on the end of cam follower arm 18, and is in operative contact with dual cam 12.

Dual cam 12 includes second cam surface 31 that is in contact with cam follower 41 for the outer suction cups 11 As the motor 22 turns the dual cam 12, surface 31 will push against cam follower 41 and correspondingly cause the pivot arm to pivot and the suction cup 11 to rise and fall depending on the depth of the cam surface 31 at a particular angular position.

The effect of the different cam surfaces 32 and 31 are depicted in FIGS. 3 and 4. In FIG. 3, cam followers 41 and 42 are in the rotational region 34 of dual cam 12 where surfaces 32 and 31 have the same profile. Thus, in that region 34 the outer 11 and inner 21 suction cups will rise and fall together as the dual cam 12 is rocked back and forth through that region.

In FIG. 4, a smaller envelope 37 is being opened, so it is desired that only the middle suction cup 21 be used. Accordingly, dual cam 12 is rotated to a different region 35 where the surfaces 32 and 31 are different. In that region, cam follower 41 is at a constant large radial distance from the center of the dual cam 12, and therefore the outer suction cups 11 will not move. For that same region 35, surface 32 is variable, and therefore as the cam oscillates in that region 35, the middle suction cup 21 will go up and down.

Figure 5:
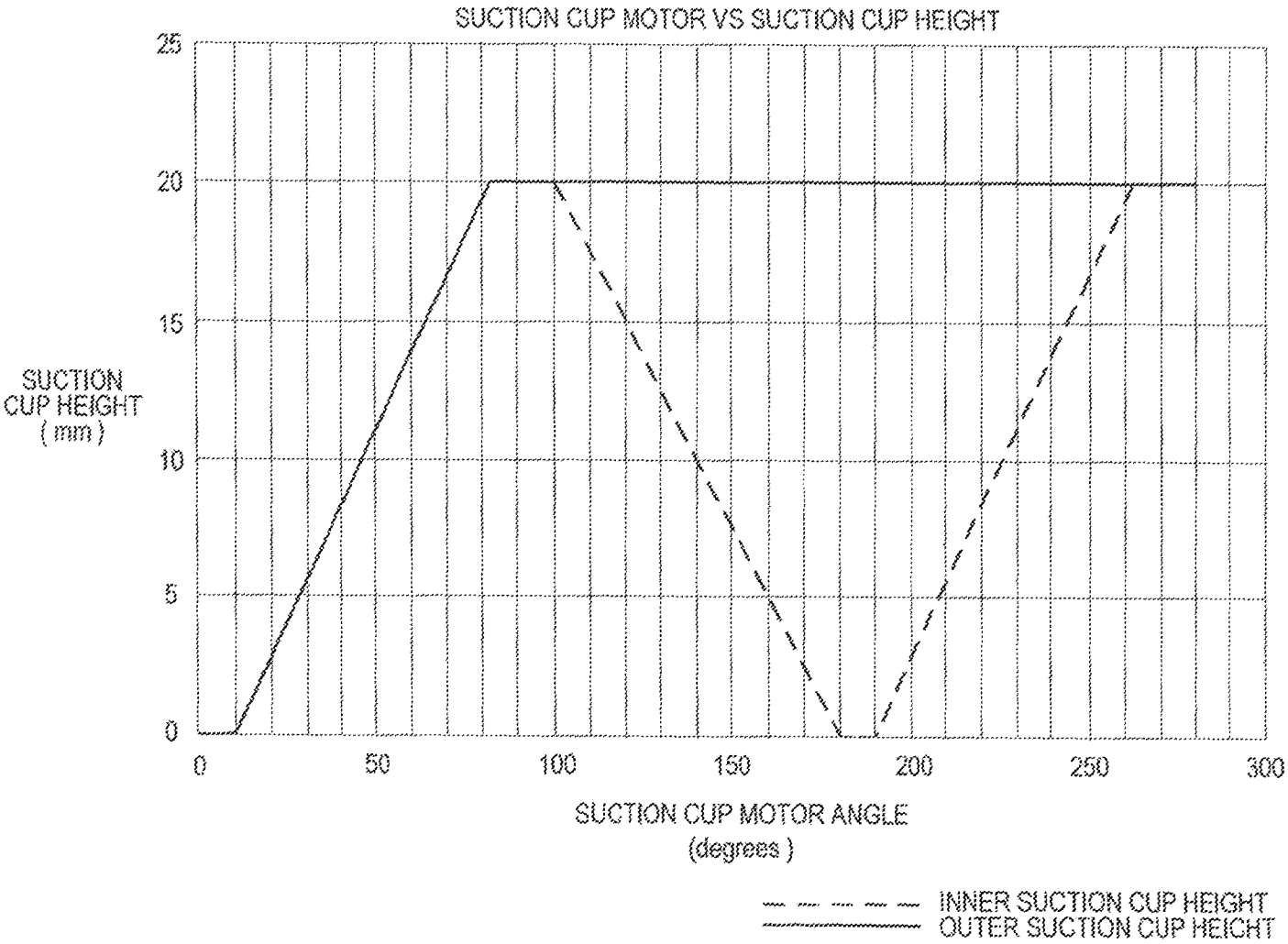
FIG. 5 is a graph showing the respective motion profiles for the inner and outer suction cups, depending on the angular position of the cam motor.

FIG. 5 shows a motion profile for the suction cups 21 and 11 depending on the rotational angle of the motor 22 turning the dual cam 12. As seen in the graph, for envelopes larger than 200 mm wide, the dual cam 12 operates in the region of 10 to 80 degrees. This causes all three suctions cups 21 and 11 to go up and down in unison as the motor oscillation in the 10-80 degree region. In the operating region, the motor angle is proportional to the opening height of the suction cup. If an opening height of 10 mm is desired, the motor 22 will move from 10 degrees to approximately 45 degrees to open the proper amount as seen in the chart.

For envelopes smaller than 200 mm wide, the outer cups 11 are not needed as they interfere with other mechanisms beneficial to insertion and a single center cup 21 is preferred. For this configuration, the motor 22 driving the dual cam 12 will operate in the 190 to 260 degree region of the cam. In this region, the outer suction cups 11 remain up all the time and only the center cup 21 will go up and down as the motor 22 oscillates. As in the three suction cup operating mode, the high can be varied by limiting the amplitude of the motor oscillation.

In addition to using more or less suction cups based on the width of the envelopes to be opened, there are other envelope characteristics that might require different sets of suction cups. These characteristics include stiff envelope material, suction resistant envelope material, or lamer than standard collation sizes.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. An apparatus for opening an envelope for insertion of a collation in an envelope inserting machine, the apparatus including:

a plurality of actuated suction cups that are positioned above an envelope in an insertion station, and wherein the actuated suction cups move downward to engage a top surface of the envelope and to lift the top surface away from a bottom surface in order to facilitate insertion of the collation, and wherein the plurality of actuated suction cups further comprises:

a first group of one or more actuatable suction cups that is actuated for opening all sizes of envelopes; and a second group of one or more actuatable suction cups that is independently actuatable from the first group, and that is selectively actuated for opening envelopes having characteristics that require the second group;

wherein the plurality of suction cups are mounted on pivot arms that are engaged with a cam mechanism that causes the suction cups to be pivotably raised and lowered; and wherein the first group of one or more suction cups is mounted on one or more first pivot arms and the second group of one or more suction cups is mounted on one or more second pivot arms, and whereby the cam mechanism includes a first cam and first cam follower for controlling the first group and a second cam and second cam follower for the second group, and wherein the first and second cams have different surface profiles that cause differing operation of the first and second groups.

2. The apparatus of claim 1 wherein the plurality of suction cups is comprised of three suction cups arranged in a line above a width of the insertion station, and the first group consists of a middle suction cup, and the second group consists of both outer suction cups.

3. The apparatus of claim 1 wherein the first and second cam are comprised from a single dual profile cam that is rotated on a single axial shaft that is turned by a motor.

4. The apparatus of claim 3 wherein the dual profile cam includes a first range of angular operation where the profiles of the first and second cams are the same, and the dual profile cam includes a second range of angular operation where the profiles are different.

5. The apparatus of claim 4 wherein the second range of angular operation of the dual profile cam causes just the first group to be actuated for envelope opening while the second group does not move.

6. The apparatus of claim 5 wherein the plurality of suction cups is comprised of three suction cups arranged in a line above a width of the insertion station, and the first group consists of a middle suction cup, and the second group consists of both outer suction cups.

7. A method of operating an envelope insertion machine for opening an envelope for insertion of a collation, the method including:

positioning a plurality of actuated suction cups that are above an envelope in an insertion station, and wherein the actuated suction cups are moved downward to engage a top surface of the envelope and to lift the top surface away from a bottom surface in order to facilitate insertion of the collation:

actuating a first group of the one or more actuated suction cups for opening all sizes of envelopes; and actuating a second group of the one or more actuated suction cups, independently actuatable from the first group, and only for opening envelopes having characteristics that require the second group;

including a step of controlling the plurality of suction cups by mounting them on pivot arms that are engaged with a cam mechanism that causes the suction cups to be pivotably raised and lowered; and wherein the step of controlling further includes mounting the first group of one or more suction cups on one or more first pivot arms and the second group of one or more suction cups on one or more second pivot arms, and whereby the cam mechanism includes a first cam and first cam follower controlling the first group and a second cam and second cam follower for the second group, and wherein the first and second cams have different surface profiles that cause differing operation of the first and second groups.

8. The method of claim 7 wherein the characteristic for requiring the second group includes one or more of the following, larger than standard size envelopes, stiff envelope material, suction resistant envelope material, or larger than standard collation sizes.

9. The method of claim 7 wherein positioning of the plurality of suction cups includes arranging three suction cups in a line above a width of the insertion station, and the first group consists of a middle suction cup, and the second group consists of both outer suction cups.

10. The method of claim 7 wherein step of controlling is achieved by having the first and second cam comprised from a single dual profile cam and rotating it on a single axial shaft that is turned by a motor.

11. The method of claim 10 wherein the step of controlling is achieved by having the dual profile cam include a first range of angular operation where the profiles of the first and second cams are the same, and a second range of angular operation where the profiles are different.

12. The method of claim 11 wherein the second range of angular operation of the dual profile cam causes just the first group to be actuated for envelope opening while the second group does not move.

13. The method of claim 12 wherein the plurality of suction cups is arranged to comprise three suction cups arranged in a line above a width of the insertion station, and the first group consists of a middle suction cup, and the second group consists of both outer suction cups.

* * * * *